US006006370A

United States Patent [19]

Wu

[11] Patent Number: 6,006,370

[45] Date of Patent: Dec. 28, 1999

[54] TOILET SEAT ASSEMBLY WITH A STACK OF STRIPPABLE SANITARY SHEETS

[76] Inventor: Yen Chen Wu, No. 129, Chai-Tien, 5th Lin, Chai-Tien Li, Hsan Hsai Town, Taipei Hsien, Taiwan

[21] Appl. No.: 09/354,306

[22] Filed: Jul. 16, 1999

[51] Int. Cl.[6] ..... A47K 13/16

[52] U.S. Cl. ..... 4/244.3; 4/245.3

[58] Field of Search ..... 4/244.1, 244.3, 4/245.1, 245.6, 245.8, 245.3, 245.5

[56] References Cited

U.S. PATENT DOCUMENTS

| | | | |
|---|---|---|---|
| 1,194,073 | 8/1916 | Romine | 4/244.3 |
| 1,720,581 | 7/1929 | Vander Leun | 4/245.8 |
| 2,011,038 | 8/1935 | Craig | 4/244.3 |
| 3,967,325 | 7/1976 | Rodriguez | 4/244.3 |

FOREIGN PATENT DOCUMENTS

| | | | |
|---|---|---|---|
| 4-215732 | 8/1992 | Japan | 4/244.3 |

*Primary Examiner*—Charles R. Eloshway
*Attorney, Agent, or Firm*—Rosenberg, Klein & Lee

[57] ABSTRACT

A toilet seat assembly, which includes a seat base pivoted to a mounting frame at a toilet bowl, a seat pad detachably fastened to the seat base by a plug joint, a stack of strippable sanitary sheets adhered to the seat pad for the sitting of the user, and a seat cover pivoted to the mounting frame for covering the sanitary sheets to protect the sanitary sheets against contamination.

2 Claims, 3 Drawing Sheets

TOILET SEAT ASSEMBLY WITH A STACK OF STRIPPABLE SANITARY SHEETS

BACKGROUND OF THE INVENTION

The present invention relates to a toilet seat assembly for a toilet, and more particularly to such a toilet seat, which is equipped with a stack of strippable sanitary sheets that can be taken off one another to keep the seat area clean.

In order to prevent contamination, disposable sanitary sheets may be provided in a bathroom for covering the seat of the toilet upon each use. These disposable sanitary sheets are commonly made of tissue paper. Upon each use of the toilet, the user shall have to pick up one disposable sanitary sheet from the sanitary sheet storage box, and then cover the sanitary sheet on the seat of the toilet. Because the disposable sanitary sheets are made of tissue paper, they tend to be moistened. Further, because the disposable sanitary sheets are arranged in a stack and received in a box, it is inconvenient to pick up one sanitary sheet from the box and then to cover the sanitary sheet on the seat of the toilet. These drawbacks impart a barrier to people, causing people to have little interest in using a sanitary sheet upon each use of the toilet.

SUMMARY OF THE INVENTION

The present invention has been accomplished under the circumstances in view. According to the present invention, the toilet seat assembly comprises a seat base and a seat cover respectively pivoted to a mounting frame at the bowl of a toilet, a seat pad detachably fastened to the seat base by a plug joint, and a stack of strippable water-tight sanitary sheets adhered to the seat pad. The strippable water-tight sanitary sheets can be conveniently taken off one after another upon each use of the toilet.

DETAILED DESCRIPTION OF THE PREFERRED EMBODIMENT

Figure 1:
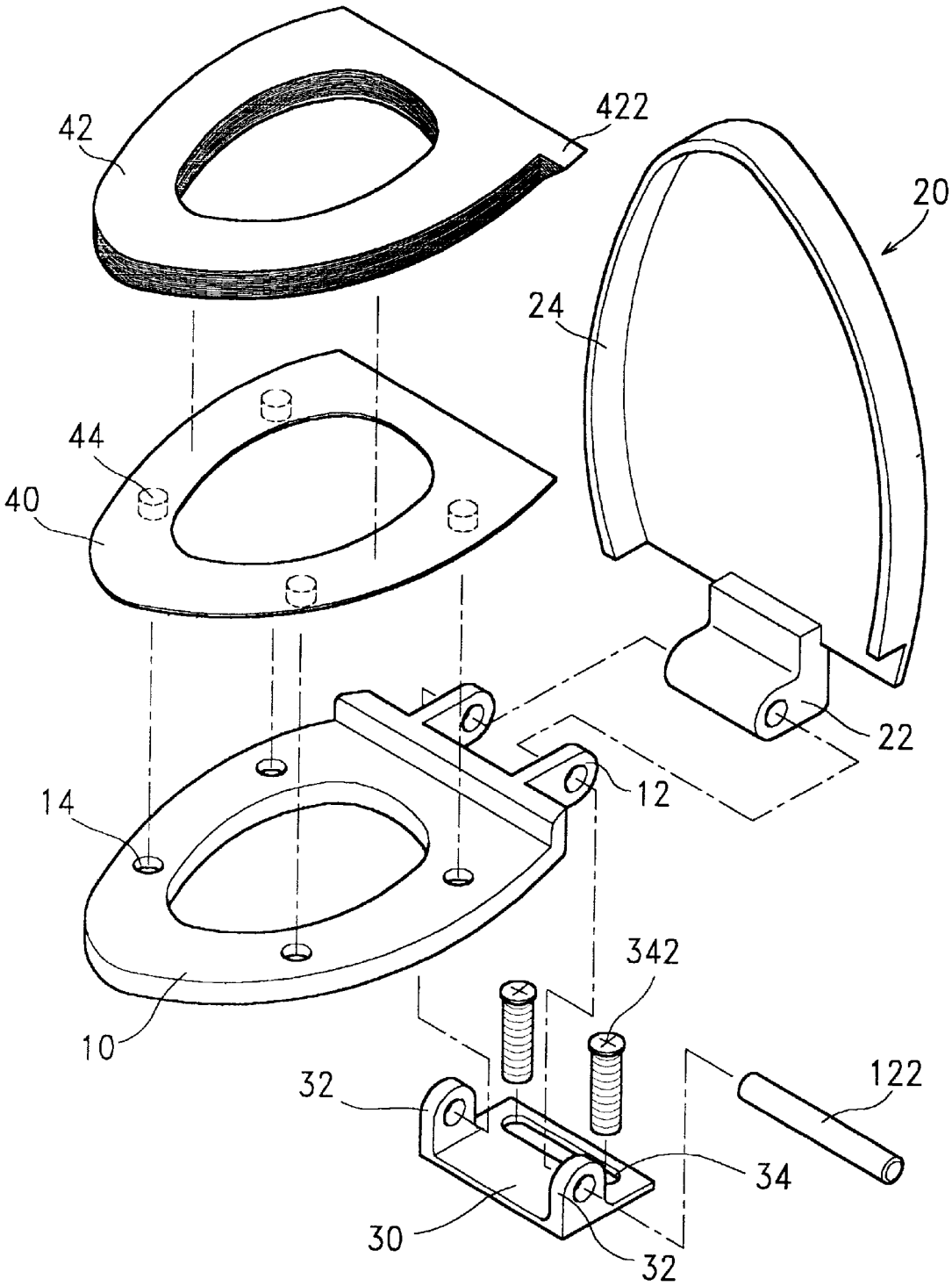
FIG. 1 is an exploded view of a toilet seat assembly according to the present invention.
Figure 2:
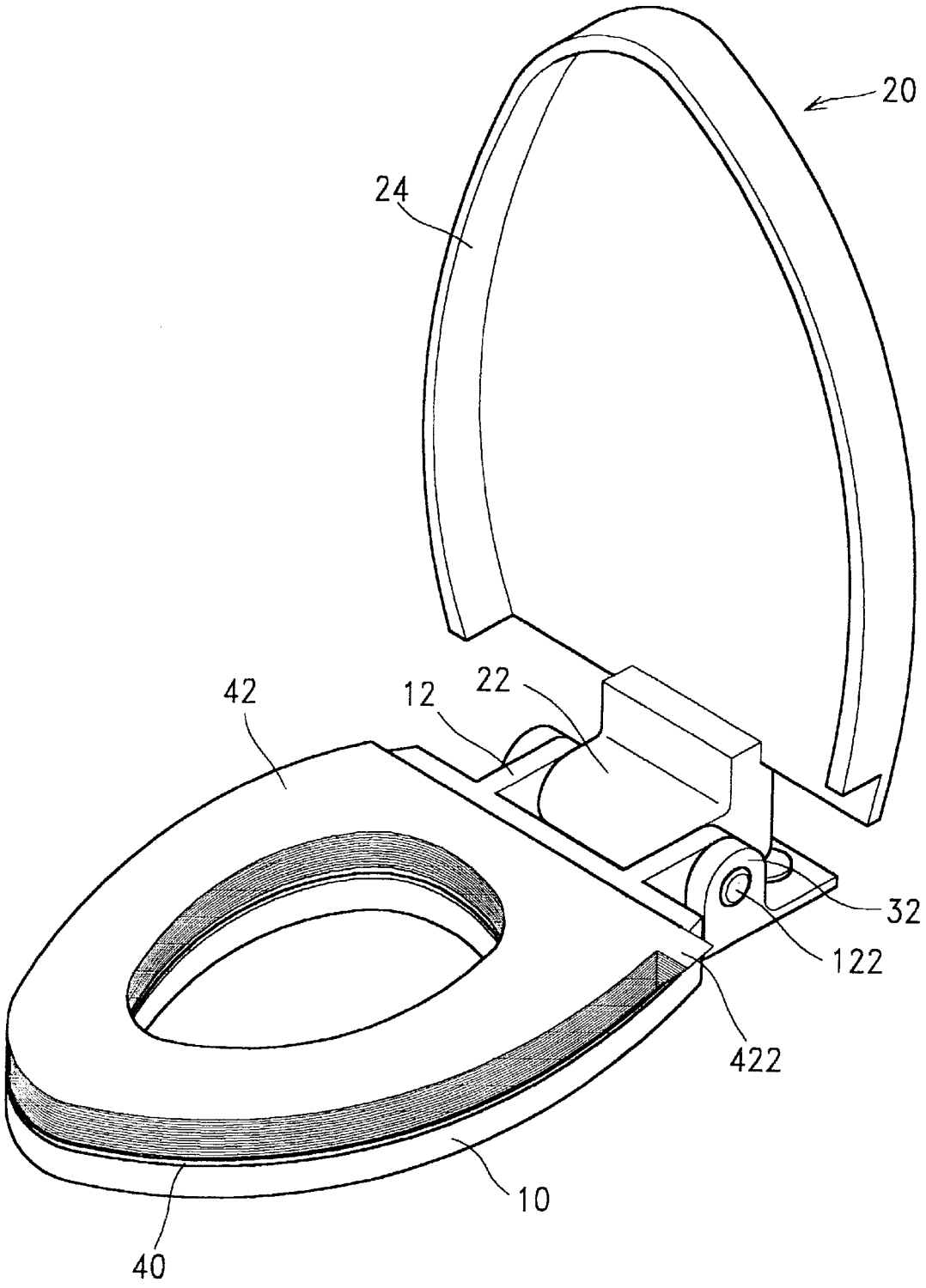
FIG. 2 is an assembly view of the toilet seat assembly according to the present invention.
Figure 3:
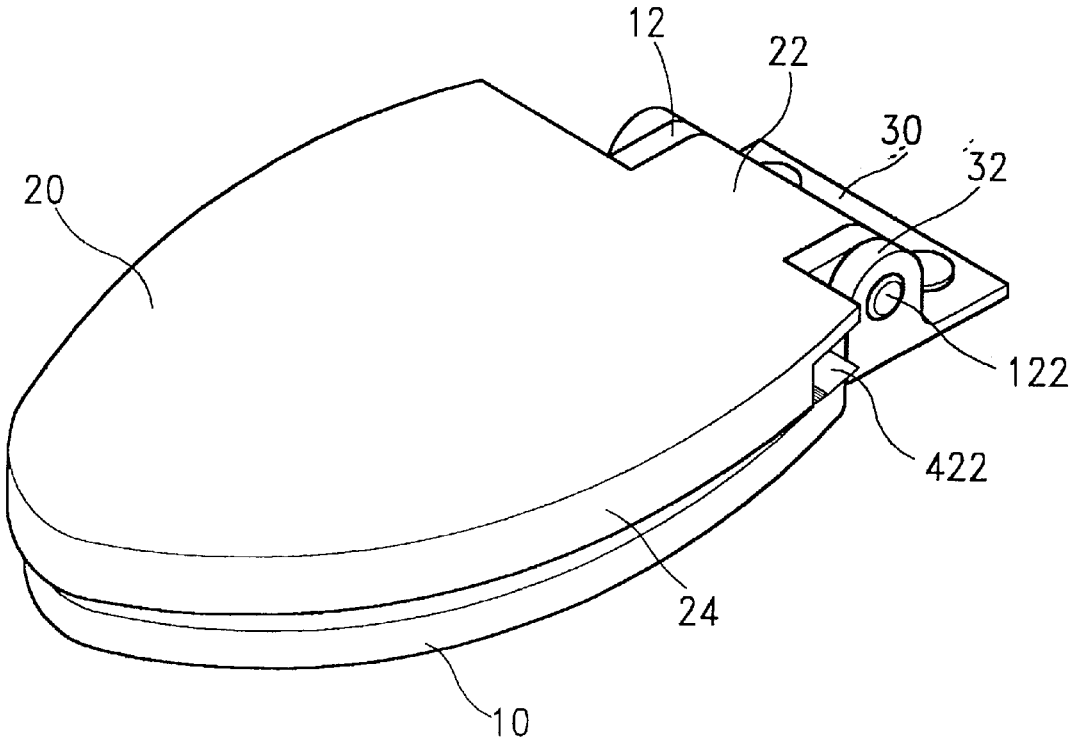
FIG. 3 is similar to FIG. 2 but showing the seat cover covered on the stack of sanitary sheets.

Referring to FIGS. from 1 through 3, a toilet seat assembly is shown comprised of a seat base 10, a seat cover 20, a mounting frame 30, a seat pad 40, and a stack of strippable sanitary sheets 42. The seat base 10 comprises a plurality of plug holes 14 at its top side wall, and two backwardly extended parallel lugs 12 at its rear side. The seat cover 20 comprises a peripheral flange 24 perpendicularly and downwardly raised around the periphery, and a coupling block 22. The mounting frame 30 comprises an elongated slot 34, and two upright lugs 32 arranged in parallel. The seat pad 40 fits over the top side wall of the seat base 10, having a plurality of downward plug rods 44 respectively plugged into the plug holes 14 at the seat base 10. The stack of sanitary sheets 42 are adhered to the top side wall of the seat pad 40, each sanitary sheet 42 having a stripping head 422 of substantially triangular cross section for the holding of the fingers. Through the stripping head 422 at each sanitary sheet 42, the sanitary sheets 42 can conveniently be taken off one after another. The sanitary sheets 42 are made of water tight material, for example, water tight paper or plastics.

During installation, the screws 342 are mounted in the elongated slot 34 to fixedly secure the mounting frame 30 to the toilet bowl (not shown), and a pivot 122 is fastened to the upright lugs 32 at the mounting frame 30, the backwardly extended parallel lugs 12 at the seat base 10 and the coupling block 22 at the seat cover 20, enabling the seat base 10 and the seat cover 20 to be respectively turned about the pivot 122.

When in use, the topmost sanitary sheet is taken off from the stack of sanitary sheets 42. When not in use, the seat cover 20 is covered on the stack of sanitary sheets 42. Because the seat cover 20 has a peripheral flange 24, the stack of sanitary sheets 42 are well protected against contamination. Further, when the stack of sanitary sheets 42 are used up, the seat pad 40 is removed from the seat base 10 and thrown away, and a new seat pad 40 with a new stack of sanitary sheets 42 are installed in the seat base 10 again.

While only one embodiment of the present invention has been shown and described, it will be understood that various modifications and changes could be made thereunto without departing from the spirit and scope of the invention disclosed.

What the invention claimed is:

1. A toilet seat assembly comprising:

a mounting frame, said mounting frame comprising an elongated slot adapted to be fixedly fastened to a toilet bowl by screws, two upright lugs arranged in parallel, and a pivot connected between said upright lugs;

a seat base pivoted to said mounting frame, said seat base comprising two backwardly extended parallel lugs connected to and turnable about said pivot, and a plurality of plug holes at a top side wall thereof;

a seat pad for placement on the top side wall of said seat base, said seat pad comprising a plurality of downward plug rods for respectively plugging into the plug holes at said seat base;

a stack of sanitary sheets adhered to the top side wall of said seat pad; and a seat cover pivoted to said mounting frame for covering said stack of sanitary sheets, said seat cover comprising a peripheral flange perpendicularly and downwardly raised from a top wall of said cover, and a coupling block connected to and turnable about said pivot.

2. The toilet seat assembly of claim 1 wherein said sanitary sheets each have a stripping head, said stripping heads, when stacked, having a triangular cross section for enabling said sanitary sheets to be taken off one after another by hand.

* * * * *

UNITED STATES PATENT AND TRADEMARK OFFICE

CERTIFICATE OF CORRECTION

PATENT NO. : 6,006,370

DATED : DEC. 28, 1999

INVENTOR(S) : YEN CHENG WU

It is certified that error appears in the above-identified patent and that said Letters Patent is hereby corrected as shown below:

On the title page item:
[76]; delete the middle name of the inventor "Chen" and insert therefor the name --Cheng--.

Signed and Sealed this

Eleventh Day of July, 2000

*Attest:*

Q. TODD DICKINSON

*Attesting Officer*

*Director of Patents and Trademarks*